US005979409A

United States Patent [19]

Robinson

[11] Patent Number: 5,979,409

[45] Date of Patent: Nov. 9, 1999

[54] INTEGRAL RETURNLESS PRESSURE REGULATOR FOR A FUEL INJECTION SYSTEM

[75] Inventor: Barry Robinson, Williamsburg, Va.

[73] Assignee: Siemens Automotive Corporation, Auburn Hills, Mich.

[21] Appl. No.: 09/158,636

[22] Filed: Sep. 22, 1998

[51] Int. Cl.[6] ..... F02M 41/00

[52] U.S. Cl. ..... 123/463; 137/510; 123/456

[58] Field of Search ..... 123/463, 447, 123/467, 456, 497, 510; 137/510

[56] References Cited

U.S. PATENT DOCUMENTS

| | | | |
|---|---|---|---|
| 4,646,700 | 3/1987 | Tuckey . | |
| 4,660,597 | 4/1987 | Cowles . | |
| 4,742,845 | 5/1988 | Capoccia | 137/510 |
| 4,756,289 | 7/1988 | Rock | 123/468 |
| 4,774,923 | 10/1988 | Hayashi . | |
| 5,195,494 | 3/1993 | Tuckey . | |
| 5,220,941 | 6/1993 | Tuckey . | |
| 5,265,644 | 11/1993 | Tuckey | 123/463 |
| 5,279,327 | 1/1994 | Alsobrooks | 123/463 |
| 5,381,816 | 1/1995 | Alsobrooks | 137/510 |
| 5,398,655 | 3/1995 | Tuckey . | |
| 5,413,077 | 5/1995 | Hornby | 123/463 |
| 5,458,104 | 10/1995 | Tuckey . | |
| 5,509,390 | 4/1996 | Tuckey . | |
| 5,533,478 | 7/1996 | Robinson | 123/510 |
| 5,579,739 | 12/1996 | Tuckey et al. . | |
| 5,609,138 | 3/1997 | Mutschler | 123/463 |
| 5,619,972 | 4/1997 | Kuenzli | 123/497 |

*Primary Examiner*—Carl S. Miller

[57] ABSTRACT

The returnless regulator includes a housing having a movable diaphragm defining a portion of a fuel regulating chamber. A normally open valve receives pressurized fuel from a fuel pump and lies in communication on its opposite side with the chamber. The diaphragm includes a projection engaging a valve element for moving the valve element away from its seat and enabling increased flow of fuel from the fuel pump through the valve into the chamber in response to fuel pressure in the chamber below a predetermined fuel regulation pressure and enabling the valve member for movement toward the valve seat, thereby enabling decreased flow of fuel from the fuel pump through the valve into the chamber in response to a fuel pressure in the chamber above the predetermined fuel regulation pressure. A retainer ring has recesses registering with openings in the lower housing part in communication with the chamber for flowing fuel to the fuel rail. The retainer ring engages an O-ring seal for sealing the regulator in a socket in the fuel rail. A filter is provided the inlet port for the regulator.

13 Claims, 4 Drawing Sheets

INTEGRAL RETURNLESS PRESSURE REGULATOR FOR A FUEL INJECTION SYSTEM

TECHNICAL FIELD

The present invention relates generally to a fuel system for an internal combustion engine, for example, for an automotive vehicle, and particularly relates to a fuel pressure regulator for disposition adjacent a fuel rail for regulating the pressure within the fuel rail without a separate return conduit for returning excess fuel to the fuel tank.

BACKGROUND

In the returnless regulator system set forth in U.S. Pat. No. 5,413,077, of common assignee herewith, a fuel pump supplies a flow of fuel to a pressure regulator adjacent a fuel rail at a constant flow rate for all fuel demand modes, i.e., at all engine or vehicle speeds. The system fuel pressure provided by the fuel pump is maintained at a slightly higher pressure than the pressure in the fuel rail. The function of the returnless regulator is to reduce the pressure supplied by the fuel pump to the predetermined regulation pressure which enables the fuel pressure in the fuel rail and the fuel injectors to deliver the correct amount of fuel to the engine. Thus, the lower fuel rail pressure is determined by the returnless regulator, while the slightly higher system pressure is determined by a pressure relief valve carried within a fuel pump module located with a fuel tank. This enables the pressure regulator to be mounted on the fuel rail closer to the engine as compared to other non-return fuel systems in which a regulator is mounted in the fuel tank. The pressure relief valve enables the excess fuel to be returned to the fuel pump module without a fuel return line from the returnless regulator to the fuel pump module or fuel tank. Also, the returnless regulator can be optionally vacuumed referenced to the intake manifold so that a constant differential pressure across the fuel injectors can be maintained.

DISCLOSURE OF THE INVENTION

The present invention constitutes an improvement over the foregoing-described system as disclosed in U.S. Pat. No. 5,413,077. The improvements are constructional in nature and improve manufacturing efficiencies for the regulator and hence reduce the cost of the regulator. In accordance with the present invention, there is provided a regulator assembly having a housing carrying a movable diaphragm defining part of a fuel pressure regulating chamber, the diaphragm being biased by a spring disposed on an opposite side of the diaphragm from the chamber. The housing has a fuel inlet port leading to the chamber which lies in communication with the fuel pump which supplies fuel under pressure to the regulator. The housing also includes a fuel outlet port for delivering pressure regulated fuel to the injector fuel rail and injectors and which outlet port is exposed to, i.e., in communication with the chamber in the housing.

A normally open valve is provided in the housing for normally flowing fuel from the fuel inlet port to the fuel outlet port during operation of the vehicle. The normally open valve includes a valve body having a valve member movable in the valve body, e.g., a ball, a valve seat at one end of the valve body defining an opening and a spring engaging the valve member and biasing the member for movement toward the seat, i.e., toward a valve-closed position. The diaphragm carries an element, e.g., a projection, which is engageable with the valve member. The projection displaces the valve member away from the seat to enable increased flow of fuel from the fuel pump through the valve into the chamber in response to a fuel pressure in the chamber below a predetermined fuel regulation pressure and permits displacement of the valve member toward the seat to enable decreased flow of fuel from the fuel pump through the valve into the chamber in response to a fuel pressure in the chamber above the predetermined fuel regulation pressure.

In accordance with the present invention, the valve member, i.e., the ball, is disposed in the valve body without guides and is essentially free-floating within the valve body. Substantial marginal spacing between the valve body and the ball is provided to afford faster response time for the changes in flow due to pressure changes and also substantially smooth flow about the ball to the valve opening. Additionally, the diaphragm carries a flange which has a pair of side-by-side circular recesses lying in communication with the valve seat opening enabling flow of fuel through the valve seat opening into the recesses and into the chamber. The recesses are readily formed in the flange of the diaphragm by a machine operation and provide enhanced porting action. Further, a fuel filter is formed integrally on the fuel inlet side of the valve body. By locating the fuel filter, i.e., a screen, at the inlet to the valve body, and in addition to a main fuel filter, contamination of the fuel system is avoided.

Additionally, in certain applications additional sealing rings are required for seating the regulator in the socket adjacent the fuel rail. In the present invention, a pair of retainers are employed to capture the additional sealing rings. Specifically, an upper retainer ring is provided about a stepped portion of a lower housing part of the regulator housing. The lower housing part mounts the valve body and includes an annular surface having a plurality of openings about the valve body for flowing fuel from the chamber to the fuel rail. The upper O-ring retainer ring has a plurality of recesses and upstanding spring-biased bosses. The bosses are received in certain openings of the stepped housing part while the recesses of the retainer ring lie in registration with remaining openings of the stepped housing part to enable fuel flow from the valve body into the chamber and through the registering openings and recesses to the fuel rail. By inserting the bosses into the openings in the lower valve housing part, delivery of the fuel is assured through the registering openings and recesses while affording a retention capability for the O-ring seal captured by the retainer ring. A lower retainer ring also captures a lower O-ring seal about the lower housing part and simultaneously provides a mounting for the filter, i.e., a screen for filtering fuel flowing into the valve body.

In a preferred embodiment according to the present invention, there is provided a fuel pressure regulator assembly, comprising a housing having a movable diaphragm defining a portion of a fuel pressure regulating chamber, the housing having a fuel inlet port for receiving fuel under pressure from a fuel pump and a fuel outlet port for delivering pressure regulated fuel to fuel injectors, a normally open valve having opposite sides exposed to pressurized fuel from the fuel pump and fuel in the chamber, respectively, for flowing fuel from the fuel pump into and through the chamber, the valve comprising a valve body having a passage, a valve member movable in the passage, a valve seat adjacent one end of the valve member and defining an opening therethrough and a spring engaging the valve member and biasing the valve member for movement toward the seat, the valve member being spaced from walls of the valve body and being unguided within the valve body and a part carried by the diaphragm and engageable with the valve member to move the valve member away from the seat and enable increased flow of fuel from the fuel pump through the valve into the chamber in response to a fuel pressure in the chamber below a predetermined fuel regulation pressure and enabling the valve member for movement toward the seat thereby enabling decreased flow of fuel from the fuel pump through the valve into the chamber in response to a fuel pressure in the chamber above the predetermined fuel regulation pressure.

In a further preferred embodiment according to the present invention, there is provided a fuel pressure regulator assembly comprising a housing having a movable diaphragm defining a portion of a fuel pressure regulating chamber, the housing comprising a fuel inlet port for receiving fuel under pressure from a fuel pump and a fuel outlet port for delivering pressure regulated fuel to a fuel rail, a normally open valve having opposite sides exposed to pressurized fuel from the fuel pump and fuel in the chamber, respectively, for flowing fuel from the fuel pump into and through the chamber, the valve comprising a valve body having a passage, a valve member movable in the passage, a valve seat adjacent one end of the valve member and defining an opening therethrough and a spring engaging the valve member and biasing the valve member for movement toward the seat, the diaphragm including a central flange having a depending projection for engaging the valve element, the flange having a pair of off-center recesses formed on a side thereof in partial registration with the opening in one end of the valve body and in communication with the chamber and a part carried by the diaphragm and engageable with the valve member to move the valve member away from the seat and enable increased flow of fuel from the fuel pump through the valve into the chamber in response to a fuel pressure in the chamber below a predetermined fuel regulation pressure and enabling the valve member for movement toward the seat, thereby enabling decreased flow of fuel from the fuel pump through the valve into the chamber in response to a fuel pressure in the chamber above the predetermined fuel regulation pressure.

In a still further preferred embodiment according to the present invention, there is provided a fuel pressure regulator assembly, comprising a housing having a movable diaphragm defining a portion of a fuel pressure regulating chamber, the housing having a fuel inlet port for receiving fuel under pressure from a fuel pump and a fuel outlet port for delivering pressure regulated fuel to fuel injectors, a normally open valve having opposite sides exposed to pressurized fuel from the fuel pump and fuel in the chamber, respectively, for flowing fuel from the fuel pump into and through the chamber, the valve comprising a valve body having a passage, a valve member movable in the passage, a valve seat adjacent one end of the valve member and defining an opening therethrough and a spring engaging the valve member and biasing the valve member for movement toward the seat and a part carried by the diaphragm and engageable with the valve member to move the valve member away from the seat and enable increased flow of fuel from the fuel pump through the valve into the chamber in response to a fuel pressure in the chamber below a predetermined fuel regulation pressure and enabling the valve member for movement toward the seat thereby enabling decreased flow of fuel from the fuel pump through the valve into the chamber in response to a fuel pressure in the chamber above the predetermined fuel regulation pressure, the housing including a lower housing part having a plurality of steps with a first step forming a seat for an end of the valve body opposite the valve seat, the lower housing part including an annular surface about the valve body and having a plurality of circumferentially spaced openings therethrough, a retainer ring having a plurality of circumferentially spaced recesses therethrough and circumferentially spaced bosses projecting therefrom, the bosses being receivable in a predetermined number of the lower housing part openings less than the number of the plurality of the openings for retaining the retainer ring on the lower housing part, the retainer ring having the recesses in registration with another number of the plurality of lower housing part openings enabling flow of fuel through another number of housing part openings and the retainer recesses to the fuel injectors.

Accordingly, it is a primary object of the present invention to provide an improved returnless regulator for a fuel system of an internal combustion engine having various manufacturing efficiencies.

BEST MODE FOR CARRYING OUT THE INVENTION

Figure 1:
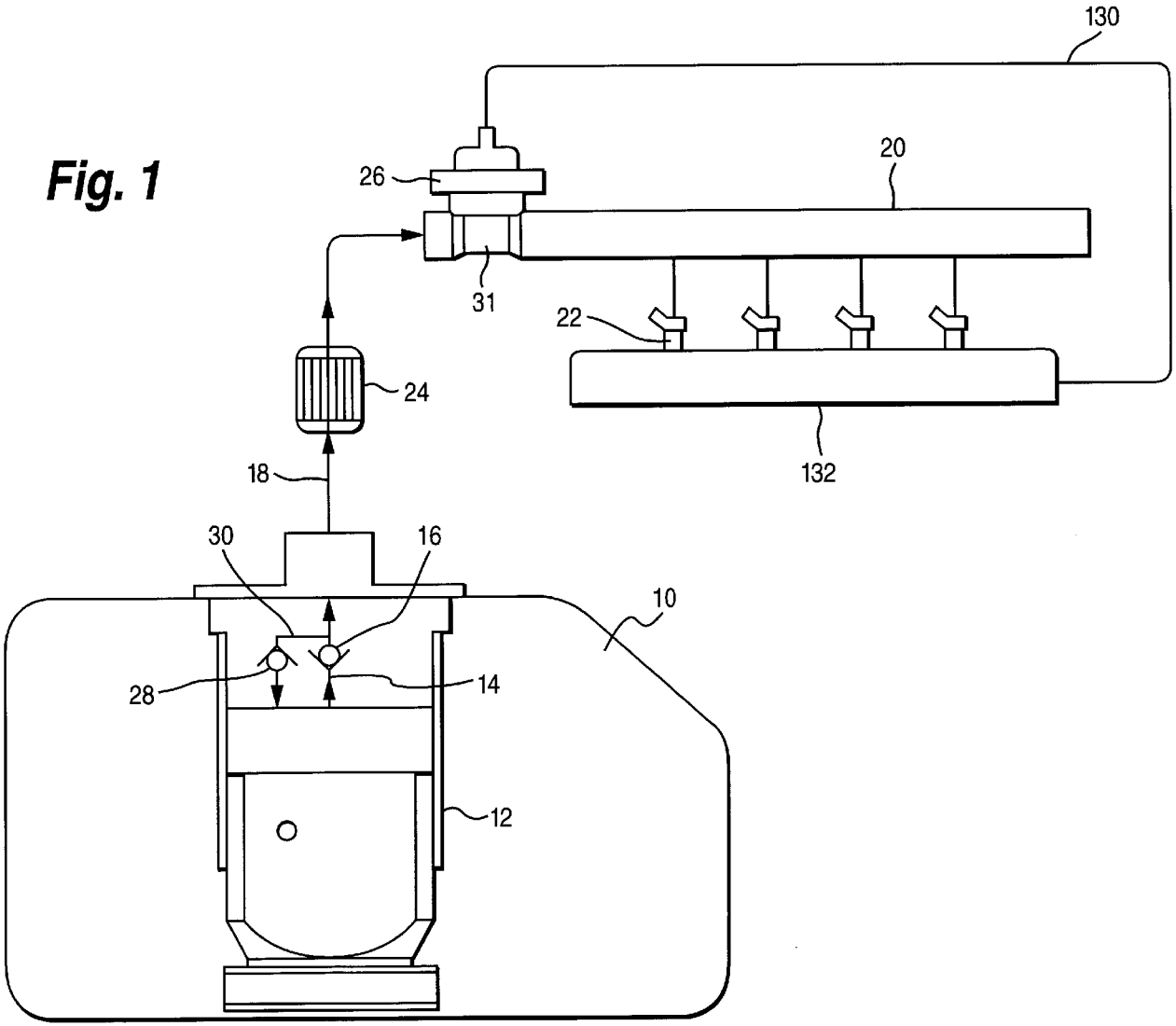
FIG. 1 is a schematic representation of a returnless fuel regulator system according to the present invention.
Figure 2:
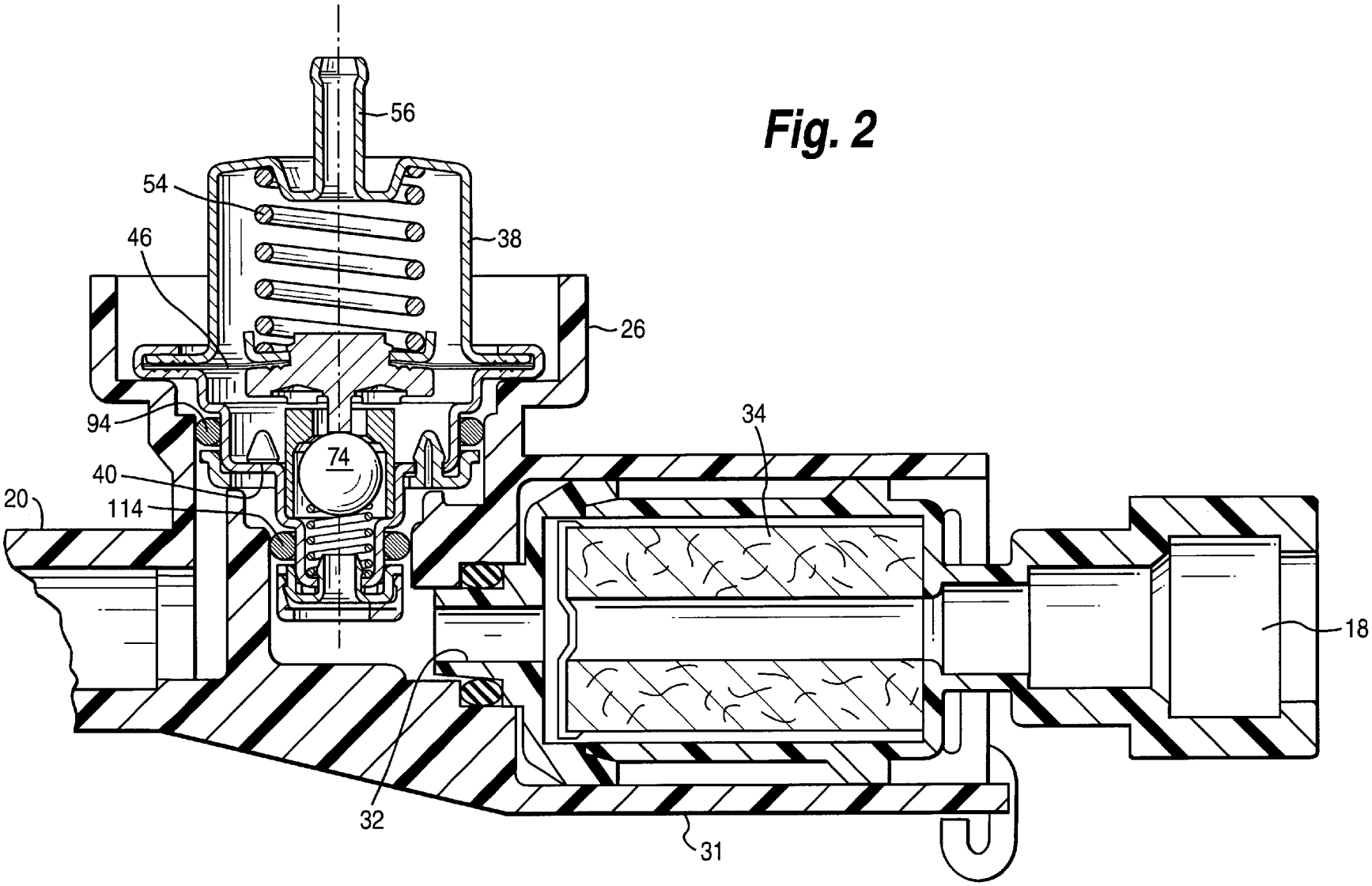
FIG. 2 is a fragmentary cross-sectional view of the end of a fuel rail with a returnless regulator disposed in a socket thereof, all constructed in accordance with the present invention.

Referring now to drawing FIG. 1, there is illustrated a returnless regulator fuel system which includes a fuel tank 10, a fuel pump module 12 for pumping fuel at a constant flow rate, a fuel line 14 within the fuel pump module containing a check valve 16, a main supply fuel line 18 for supplying fuel from the pump module 12 and tank 10 to a fuel rail 20 and, hence, to injectors 22, in communication with the fuel rail, a primary fuel filter 24 in line 18 and an integral returnless regulator 26 constructed in accordance with the present invention carried by an end socket 31 of the fuel rail 20. As will be appreciated, fuel pump module 12 pumps fuel at a constant flow rate at a system pressure in line 18 higher than a predetermined regulated pressure of the fuel in fuel rail 20 and injectors 22, the reduction in pressure being accomplished by the returnless regulator 26. Excess fuel is returned to the fuel pump module by way of a pressure relief valve 28 and connecting line 30 within the fuel pump module.

At the fuel inlet end 18 to the fuel rail 20, the generally cylindrical socket 31 is coaxial with the fuel rail 20. Socket 31 opens at one end to line 18 and reduces down at its opposite end to a reduced axial passage 32 for flowing fuel from line 18 to the regulator 26. A main fuel filter cartridge 34 is disposed in the enlarged diameter portion of socket 31 for flowing fuel under pressure from line 18 through the annular cartridge 34 and into passage 32 for flow to the regulator 26.

Regulator 26 comprises a generally cylindrical housing having an upper, generally inverted cup-shaped housing part 38 and a stepped lower housing part 40 joined and sealed to one another with confronting margins 42 and 44, respectively. The margins 42 and 44 also clamp between them the outer margin of a diaphragm 46 mounting a central flange or part 48. Part 48 includes a lower annular rim 50 underlying an inner margin of diaphragm 46. An upper, generally cup-shaped flange 52 is secured to an upper end portion of part 48 and receives the lower end of a helical coil spring 54. The upper end of spring 54 bears against the upper end of upper housing part 38 and surrounds a nipple 56. In one form of the present invention, nipple 56 is open to the atmosphere. Consequently, spring 54 resides in an upper chamber 58, while the diaphragm 46 defines in part a lower chamber 60.

Figure 3:
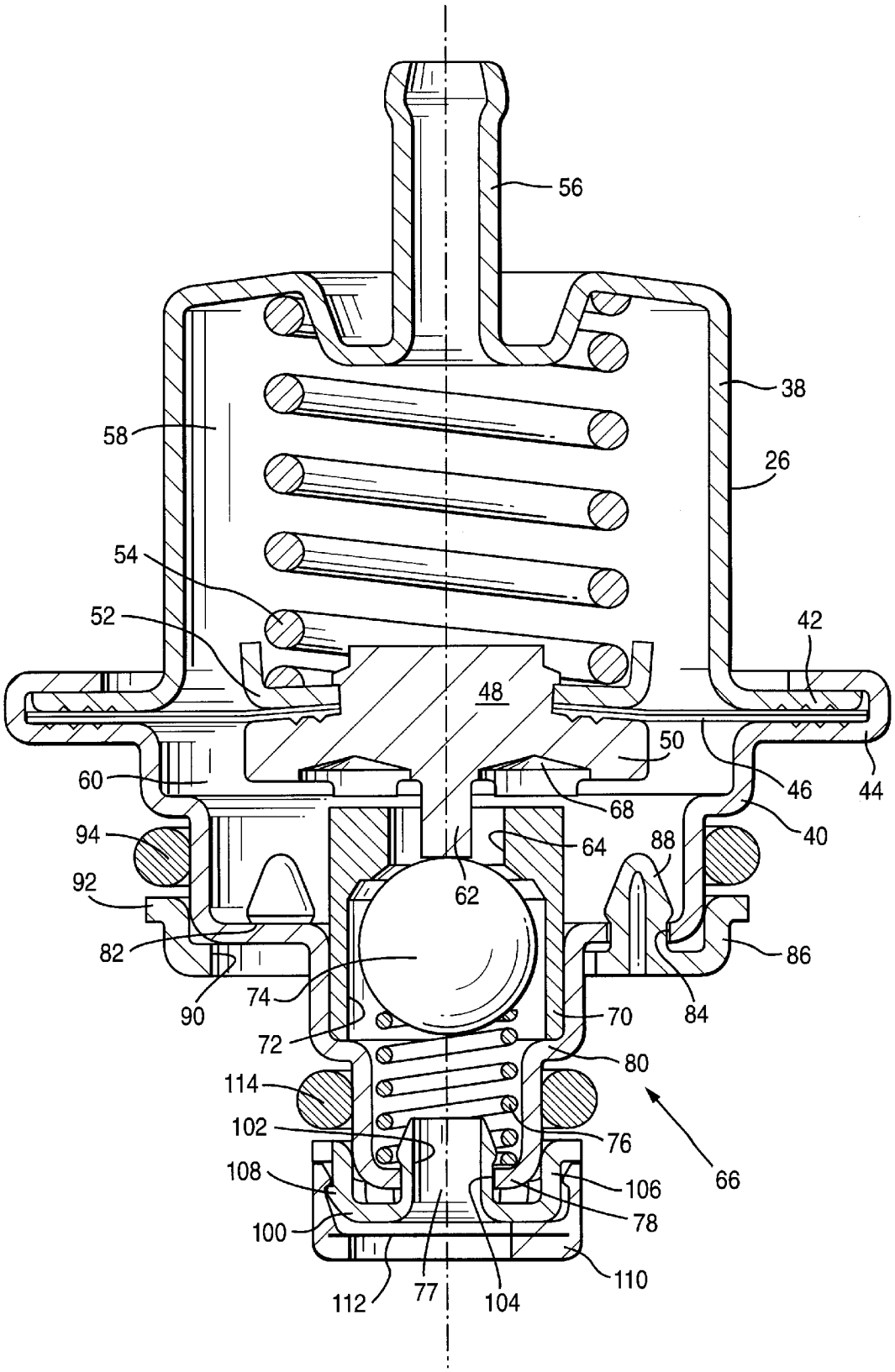
FIG. 3 is an enlarged cross-sectional view of the pressure regulator contained within the fuel rail end.

In accordance with the present invention, part 48 includes a central, generally axially extending projection 62 which extends downwardly into an opening 64 forming part of a normally open valve assembly, generally designated 66, and described hereinafter. The underside of part 48 includes a pair of cylindrical recesses 68 having centers lying on a common diameter and spaced from the axis of part 48. The recesses 68, as illustrated in FIG. 3, in part overlie the opening 64 of the valve assembly 66 and in part open into chamber 60. The recesses 68 are preferably formed by machining the underside of the metal part 48 and form ports for flowing fuel from valve 66 into chamber 60.

The valve assembly 66 includes a cylindrical valve body 70 which comprises the valve opening 64 at an upper end thereof surrounded by valve seat 65 and an enlarged cylindrical passage 72 in which a valve element 74, for example, a ball, is disposed. As illustrated in FIG. 3, ball 74 is free-floating in passage 72, i.e., it is spaced a substantial distance from the side walls of the valve body 70. Valve element 74 rests on an underlying coil spring 76. The lower end of the coil spring 76 bears on an in-turned flange 78 forming the lower terminus of the lower housing part 40. The coil spring 76 biases the ball upwardly and it will be appreciated that it engages the tip of the downward projection 62 of part 48, as illustrated. The lower terminus of lower housing part 40 includes an opening 77 defining a fuel inlet port for the regulator.

In a specific preferred embodiment hereof, the ball 74 has a diameter well short of the diameter of the cylindrical passage 72 to provide increased response time to changes in pressure and virtually unobstructed flow past the ball to the valve opening. The ball diameter is 7.144 mm and the diameter of the passage 72 is 8.05 mm, providing a flow area of 10.806 $mm^2$ past the ball. Preferably, this area should be between 15–25% of the area of the passage 72. Thus, by omitting guides which afford obstructions to the free flow of fuel past the ball and spacing the ball from the interior wall surfaces of the valve body, not only is improved fuel flow achieved but manufacturing efficiency and reduced cost is afforded.

Figure 7:
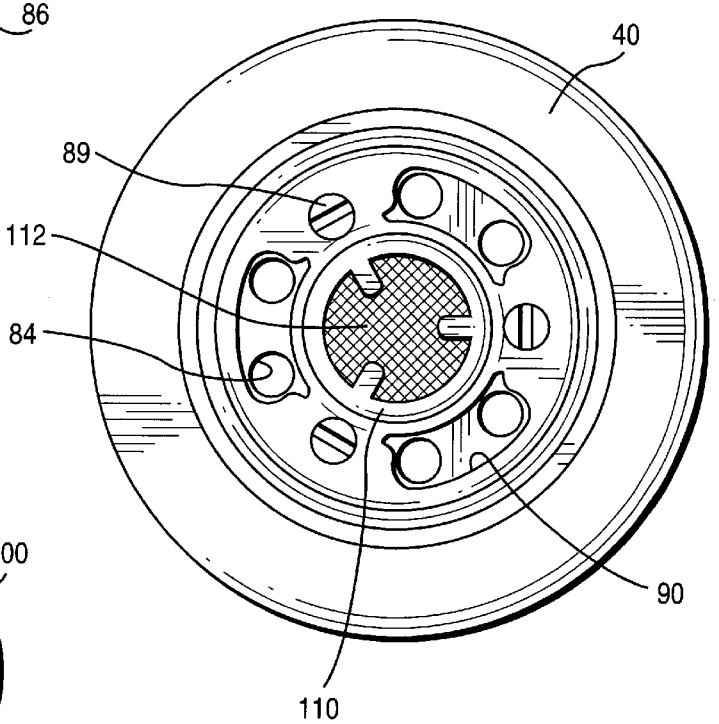
FIG. 7 is a bottom plan view of the regulator illustrating the fuel filter and the upper retainer ring.
Figure 4:
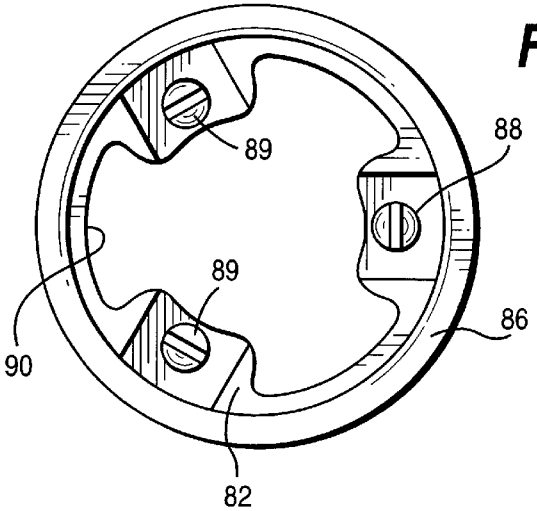
FIG. 4 is a reduced top plan view of an upper retainer ring used in the regulator illustrated in FIG. 3.
Figure 6:
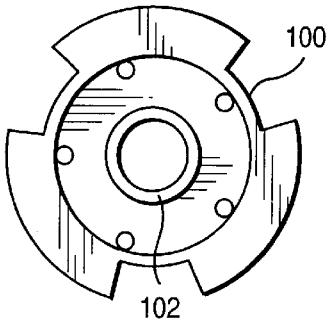
FIG. 6 is a plan view of an upper portion of a second retainer ring used in the regulator illustrated in FIG. 3.
Figure 5:
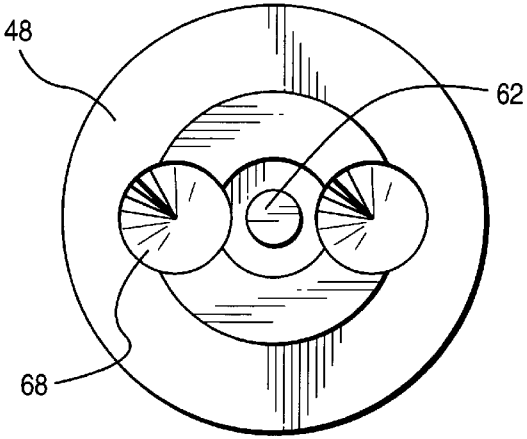
FIG. 5 is a cross-sectional view of the underside of the flange of the diaphragm of the regulator of FIG. 3.

The lower housing part 40 includes a number of reduced diameter steps toward its lower in-turned flange 78. The step 80 forms a seat for the lower end of the valve body 70. In an annular surface 82 extending about valve body 70 and forming the next step above step 80, there is provided a plurality of circumferentially spaced openings 84. A retainer ring 86 is disposed externally about the lower housing part 40 below annular surface 82 and includes a plurality of upstanding bosses 88. Each boss 88 includes opposed, generally semi-circular resilient parts 89, each having rims 90, such that the parts 89 of bosses 88 can be received in a predetermined number of the openings 84. In the lower housing part 40, there is provided a total number of openings in excess of the number of bosses, for example, three bosses 88, are provided, while nine openings are provided through the annular surface 82. The retainer ring also includes recesses 90 (FIGS. 3, 4 and 7) underlying the surface 82 and particularly underlying adjacent remaining pairs of openings 84 which are not occupied by bosses 88. That is, each recess 90 registers with two openings 84 of the lower housing part whereby fuel can flow from chamber 60 through openings 84 and recesses 90 into the fuel rail. The retainer ring 86 has an outwardly directed flange 92. Flange 92 forms a retaining flange for an O-ring seal 94 for sealing the regulator within the socket 30 on the end of the fuel rail.

At the lower end of the lower housing part 40, there is provided a lower retainer ring comprised of an annular, generally cup-shaped member 100, having a central upstanding nipple 102 received within the opening 104 of the lower housing part 40. The nipple includes a radially enlarged edge for a snap-fit past the margins of opening 104 for retention on the lower housing part. The lower retainer ring 100 includes an upstanding outer wall 106 having a plurality of ledges 108 spaced thereabout for retaining a generally cup-shaped filter element 110 on the retainer ring 100. The filter element 110 comprises an annular member having a screen 112 through which fuel is filtered upon passing through the screen and into the lower housing part 40. The filter element 110 includes an inwardly directed flange for engaging over ledge 108 whereby the filter is secured to the regulator. The lower retainer ring 100 serves not only to secure the fuel filter 112 to the regulator but also to retain an additional O-ring seal 114 on the last reduced diameter portion of the stepped lower housing part 40.

In operation, fuel is supplied to the regulator 26 at a substantially constant flow rate and substantially constant pressure by the fuel pump module 12. As noted above, the function of the regulator is to reduce the supplied fuel pressure to a predetermined regulator pressure such that a constant flow rate of fuel at constant regulated pressure is supplied to the fuel rail and fuel injectors. The regulator has three different operating modes. In a first operating mode, in which the engine is running and variable loads are being imposed on the engine, the regulator valve is movable to increase or decrease the fuel flow through the valve to the fuel rail. That is, as the engine consumes more fuel, the valve opens further to increase the flow rate of fuel to the fuel rail and, as the engine uses less fuel, the valve decreases the flow rate of fuel to the fuel rail and injectors. More particularly, as the engine uses more fuel, the pressure acting on the chamber 60 will decrease and the spring 54 causes the diaphragm 46 to move toward the valve assembly 66. Projection 62 thus moves downwardly as illustrated in FIG. 3 to displace the valve member 74 further from the valve seat 65 about the valve opening 64 and against the bias of spring 76 to increase the flow of fuel through the valve into the fuel rail. Specifically, the fuel flows under pressure through the inlet port 77 past nipple 102 into the valve body 70, about ball 90, past seat 65 and through valve opening 64. Upon passing opening 64, the fuel enters the recesses 68 of the diaphragm part 48 and reverses direction for flow into chamber 60 and through the openings 84 which register with the recesses 90 of the upper retaining ring 86 for flow into the fuel rail. As the engine throttles down and reduced fuel consumption occurs, the fuel pressure increases in chamber 60, displacing the diaphragm 46 away from the valve 66 and against the bias of spring 54. This, in turn, enables spring 76 to move valve element 74 closer to the valve seat 65, hence reducing the flow of fuel through the valve and maintaining the fuel at the regulated pressure. During a hard deceleration condition, the fuel pressure in chamber 60 increases and the valve closes. The valve will stay closed until the injectors fire again. To ensure closing and non-leakage of fuel through the valve, the valve sealing surface or seat 65 is coined.

A second mode of operation occurs when the vehicle is shut off. In that mode, the valve 66 remains open and the fuel rail pressure and the system pressure equalize. The pressure relief valve 28 has a closing time associated with it and seals when the pressure is equalized so that the vehicle will have fuel under pressure during a restart. The check valve 16 is located in the fuel pump and this check valve also seals the system, maintaining the system pressure.

In a third operating mode, referred to as a hot soak mode, the engine may run hot or run during hot ambient conditions. When the engine is shut off during such conditions, heat builds up in the fuel rail and hence the pressure increases. Because the regulator 26 is normally open, the valve will eventually close under these conditions. That is, as the fuel rail pressure rises, the diaphragm 46 is displaced upwardly, enabling the valve element 74 to seal against seat 65. Once sealed, the pressure continues to rise. At a predetermined pressure, the pressure per unit area on the valve element 74 will overcome the force of spring 76 and the system pressure to crack open the valve and relieve the pressure.

The regulator of the present invention can also be referenced to the intake manifold as illustrated in FIG. 1. That is, the nipple 56 can be connected via a line 130 to the fuel manifold 132. This ensures a constant differential pressure across the fuel injectors, notwithstanding variations in the pressure and the manifold during variable driving conditions. Hence, the change in force on the diaphragm in the control chamber 58 enables the maintenance of a constant pressure difference across the injectors under variable driving conditions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel pressure regulator assembly, comprising:

a housing having a movable diaphragm defining a portion of a fuel pressure regulating chamber, said housing having a fuel inlet port for receiving fuel under pressure from a fuel pump and a fuel outlet port for delivering pressure regulated fuel to fuel injectors;

a normally open valve having opposite sides exposed to pressurized fuel from the fuel pump and fuel in said chamber, respectively, for flowing fuel from the fuel pump into and through said chamber;

said valve comprising a valve body having a passage, a valve member movable in said passage, a valve seat adjacent one end of said valve member and defining an opening therethrough and a spring engaging said valve member and biasing said valve member for movement toward said seat, said valve member being spaced from walls of said valve body and being unguided within the valve body;

a part carried by said diaphragm and engageable with said valve member to move the valve member away from said seat and enable increased flow of fuel from the fuel pump through the valve into the chamber in response to a fuel pressure in the chamber below a predetermined fuel regulation pressure and enabling the valve member for movement toward said seat thereby enabling decreased flow of fuel from the fuel pump through the valve into the chamber in response to a fuel pressure in the chamber above the predetermined fuel regulation pressure;

said housing including an annular surface about said valve body and having a plurality of circumferentially spaced openings therethrough, a retainer ring having a plurality of circumferentially spaced recesses therethrough and circumferentially spaced bosses projecting therefrom, said bosses being receivable in a predetermined number of said housing openings less than the number of said plurality of said openings for retaining said retainer ring on said housing, said retainer ring having said recesses in registration with another number of said plurality of housing openings enabling flow of fuel through said another number of said housing openings and said retainer recesses to the fuel injectors.

2. A combination according to claim 1 including a fuel filter carried by said housing in said fuel inlet port, said valve member and the walls of said valve body defining a valve passageway therebetween in a range of 15–25% of the area defined by the walls of said valve body.

3. A combination according to claim 2 including a lower retainer ring secured to said housing and carrying said fuel filter and an O-ring seal about said housing and engaged by said lower retainer ring.

4. A fuel pressure regulator assembly, comprising:

a housing having a movable diaphragm defining a portion of a fuel pressure regulating chamber, said housing having a fuel inlet port for receiving fuel under pressure from a fuel pump and a fuel outlet port for delivering pressure regulated fuel to fuel injectors;

a normally open valve having opposite sides exposed to pressurized fuel from the fuel pump and fuel in said chamber, respectively, for flowing fuel from the fuel pump into and through said chamber;

said valve comprising a valve body having a passage, a valve member movable in said passage, a valve seat adjacent one end of said valve member and defining an opening therethrough and a spring engaging said valve member and biasing said valve member for movement toward said seat, said valve member being spaced from walls of said valve body and being unguided within the valve body;

a part carried by said diaphragm and engageable with said valve member to move the valve member away from said seat and enable increased flow of fuel from the fuel pump through the valve into the chamber in response to a fuel pressure in the chamber below a predetermined fuel regulation pressure and enabling the valve member for movement toward said seat thereby enabling decreased flow of fuel from the fuel pump through the valve into the chamber in response to a fuel pressure in the chamber above the predetermined fuel regulation pressure;

said housing including a lower housing part having a plurality of steps with a first step forming a seat for an end of said valve body opposite said valve seat, said lower housing part including an annular surface about said valve body and having a plurality of circumferentially spaced openings therethrough, a retainer ring having a plurality of circumferentially spaced recesses therethrough and circumferentially spaced bosses projecting therefrom, said bosses being receivable in a predetermined number of said lower housing part openings less than the number of said plurality of said openings for retaining said retainer ring on said lower housing part, said retainer ring having said recesses in registration with another number of said plurality of lower housing part openings enabling flow of fuel through said another number of said housing part openings and said retainer recesses to the fuel injectors.

5. A combination according to claim 4 including an O-ring seal about said housing part and engaged by said retainer ring.

6. A combination according to claim 4 including a filter carried by said housing part in said fuel inlet port, a lower retainer ring secured to said housing part, and an O-ring seal about said lower housing part and engaged by said lower retainer ring.

7. A fuel pressure regulator assembly comprising:

a housing having a movable diaphragm defining a portion of a fuel pressure regulating chamber, said housing comprising a fuel inlet port for receiving fuel under pressure from a fuel pump and a fuel outlet port for delivering pressure regulated fuel to a fuel rail;

a normally open valve having opposite sides exposed to pressurized fuel from the fuel pump and fuel in said chamber, respectively, for flowing fuel from the fuel pump into and through said chamber;

said valve comprising a valve body having a passage, a valve member movable in said passage, a valve seat adjacent one end of said valve member and defining an opening therethrough and a spring engaging said valve member and biasing said valve member for movement toward said seat;

said diaphragm including a central flange having a depending projection for engaging the valve member, said flange having a pair of off-center recesses formed on a side thereof in partial registration with the opening in said one end of said valve body and in communication with said chamber;

said projection carried by said diaphragm and engageable with said valve member to move the valve member away from said seat and enable increased flow of fuel from the fuel pump through the valve into the chamber in response to a fuel pressure in the chamber below a predetermined fuel regulation pressure and enabling the valve member for movement toward said seat, thereby enabling decreased flow of fuel from the fuel pump through the valve into the chamber in response to a fuel pressure in the chamber above the predetermined fuel regulation pressure;

said housing including an annular surface about said valve body and having a plurality of circumferentially spaced openings therethrough, a retainer ring having a plurality of circumferentially spaced recesses therethrough and circumferentially spaced bosses projecting therefrom, said bosses being receivable in a predetermined number of said housing openings less than the number of said plurality of said openings for retaining said retainer ring on said housing, said retainer ring having said recesses in registration with another number of said plurality of housing openings enabling flow of fuel through said another number of said housing openings and said retainer recesses to the fuel injectors.

8. A combination according to claim 7 including a filter carried by said housing in said fuel inlet port.

9. A combination according to claim 8 including a lower retainer ring secured to said housing and carrying said fuel filter and an O-ring seal about said housing and engaged by said lower retaining ring.

10. A fuel pressure regulator assembly comprising:

a housing having a movable diaphragm defining a portion of a fuel pressure regulating chamber, said housing comprising a fuel inlet port for receiving fuel under pressure from a fuel pump and a fuel outlet port for delivering pressure regulated fuel to a fuel rail;

a normally open valve having opposite sides exposed to pressurized fuel from the fuel pump and fuel in said chamber, respectively, for flowing fuel from the fuel pump into and through said chamber;

said valve comprising a valve body having a passage, a valve member movable in said passage, a valve seat adjacent one end of said valve member and defining an opening therethrough and a spring engaging said valve member and biasing said valve member for movement toward said seat;

said diaphragm including a central flange having a depending projection for engaging the valve member, said flange having a pair of off-center recesses formed on a side thereof in partial registration with the opening in said one end of said valve body and in communication with said chamber; and said projection carried by said diaphragm and engageable with said valve member to move the valve member away from said seat and enable increased flow of fuel from the fuel pump through the valve into the chamber in response to a fuel pressure in the chamber below a predetermined fuel regulation pressure and enabling the valve member for movement toward said seat, thereby enabling decreased flow of fuel from the fuel pump through the valve into the chamber in response to a fuel pressure in the chamber above the predetermined fuel regulation pressure;

said housing including a lower housing part having a plurality of steps with a first step forming a seat for an end of said valve body opposite said valve seat, said lower housing part including an annular surface about said valve body and having a plurality of circumferentially spaced openings therethrough, a retainer ring having a plurality of circumferentially spaced recesses therethrough and circumferentially spaced bosses projecting therefrom, said bosses being receivable in a predetermined number of said lower housing part openings less than the number of said plurality of said openings for retaining said retainer ring on said lower housing part, said retainer ring having said recesses in registration with another number of said plurality of lower housing part openings enabling flow of fuel through said another number of said housing part openings and said retainer recesses to the fuel injectors.

11. A combination according to claim 10 including an O-ring seal about said housing part and engaged by said retainer ring.

12. A combination according to claim 10 including a filter carried by said housing part in said fuel inlet port, a lower retainer ring secured to said housing part, and an O-ring seal about said lower housing part and engaged by said lower retainer ring.

13. A fuel pressure regulator assembly, comprising:

a housing having a movable diaphragm defining a portion of a fuel pressure regulating chamber, said housing having a fuel inlet port for receiving fuel under pressure from a fuel pump and a fuel outlet port for delivering pressure regulated fuel to fuel injectors;

a normally open valve having opposite sides exposed to pressurized fuel from the fuel pump and fuel in said chamber, respectively, for flowing fuel from the fuel pump into and through said chamber;

said valve comprising a valve body having a passage, a valve member movable in said passage, a valve seat adjacent one end of said valve member and defining an opening therethrough and a spring engaging said valve member and biasing said valve member for movement toward said seat; and a part carried by said diaphragm and engageable with said valve member to move the valve member away from said seat and enable increased flow of fuel from the fuel pump through the valve into the chamber in response to a fuel pressure in the chamber below a predetermined fuel regulation pressure and enabling the valve member for movement toward said seat thereby enabling decreased flow of fuel from the fuel pump through the valve into the chamber in response to a fuel pressure in the chamber above the predetermined fuel regulation pressure;

said housing including a lower housing part having a plurality of steps with a first step forming a seat for an end of said valve body opposite said valve seat, said lower housing part including an annular surface about said valve body and having a plurality of circumferentially spaced openings therethrough, a retainer ring having a plurality of circumferentially spaced recesses therethrough and circumferentially spaced bosses projecting therefrom, said bosses being receivable in a predetermined number of said lower housing part openings less than the number of said plurality of said openings for retaining said retainer ring on said lower housing part, said retainer ring having said recesses in registration with another number of said plurality of lower housing part openings enabling flow of fuel through said another number of said housing part openings and said retainer recesses to the fuel injectors.

* * * * *